US011448429B2

(12) United States Patent
Chamoun

(10) Patent No.: US 11,448,429 B2
(45) Date of Patent: Sep. 20, 2022

(54) AIR AND WATER COOLED CHILLER FOR FREE COOLING APPLICATIONS

(71) Applicants: Marwan Chamoun, Lyons (FR); Carrier Corporation, Palm Beach Gardens, FL (US)

(72) Inventor: Marwan Chamoun, Lyons (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 74 days.

(21) Appl. No.: 16/304,409

(22) PCT Filed: May 25, 2016

(86) PCT No.: PCT/IB2016/000847
§ 371 (c)(1),
(2) Date: Nov. 26, 2018

(87) PCT Pub. No.: WO2017/203317
PCT Pub. Date: Nov. 30, 2017

(65) Prior Publication Data

US 2019/0293326 A1 Sep. 26, 2019

(51) Int. Cl.
*F25B 6/02* (2006.01)
*F25B 41/00* (2021.01)
(Continued)

(52) U.S. Cl.
CPC ..... *F25B 6/02* (2013.01); *F25B 41/00* (2013.01); *F25B 41/20* (2021.01); *F25B 41/24* (2021.01);
(Continued)

(58) Field of Classification Search
CPC ..... F25B 41/003; F25B 41/00; F25B 41/04; F25B 6/02; F25B 6/04; F25B 25/005; F25B 2339/047
See application file for complete search history.

(56) References Cited

U.S. PATENT DOCUMENTS 3,852,974 A 12/1974 Brown
6,662,588 B2 12/2003 Houk et al.
(Continued)

FOREIGN PATENT DOCUMENTS

CN 102589114 A 7/2012
EP 1394482 A2 3/2004
(Continued)

OTHER PUBLICATIONS

International Search Report and Written Opinion for application PCT/IB2016/00847, dated Feb. 10, 2017, 11 pages.
(Continued)

*Primary Examiner* — Joseph F Trpisovsky
(74) *Attorney, Agent, or Firm* — Cantor Colburn LLP

(57) ABSTRACT

A heating, ventilation, air conditioning or refrigeration system includes a refrigerant circuit having a compressor, a first condenser, and a second condenser arranged in parallel or in series with the first condenser. A first expansion valve is in fluid communication with the first condenser to selectably direct a refrigerant flow through the first condenser, and a second expansion valve is in fluid communication with the second condenser to selectably direct the refrigerant flow through the second compressor. An evaporator is configured to remove thermal energy from a fluid flow through the evaporator via the refrigerant flow through the evaporator. A fluid flow circuit includes a liquid cooler in selectable fluid communication with the second condenser and/or the evaporator and the evaporator, through which the fluid flow is directed for thermal energy exchange with the refrigerant flow.

5 Claims, 3 Drawing Sheets

(51) Int. Cl.

| | |
|---|---|
| ***F25B 41/20*** | (2021.01) |
| ***F25B 41/24*** | (2021.01) |
| *F25B 6/04* | (2006.01) |
| *F25B 25/00* | (2006.01) |

(52) U.S. Cl.
CPC ..... *F25B 6/04* (2013.01); *F25B 25/005* (2013.01); *F25B 2339/047* (2013.01)

(56) References Cited

U.S. PATENT DOCUMENTS

| | | | | |
|---|---|---|---|---|
| 7,343,746 | B2 | 3/2008 | Pierson | |
| 8,406,929 | B2 | 3/2013 | Duncan | |
| 8,720,217 | B2 | 5/2014 | Reed | |
| 8,959,947 | B2 | 2/2015 | Zhai et al. | |
| 8,974,274 | B2 | 3/2015 | Carlson | |
| 9,125,327 | B1 | 9/2015 | Carlson et al. | |
| 9,282,684 | B2 | 3/2016 | Keisling et al. | |
| 2005/0039878 | A1* | 2/2005 | Meyer | F25B 29/003 165/42 |
| 2010/0242532 | A1 | 9/2010 | Kopko et al. | |
| 2011/0216503 | A1 | 9/2011 | Ramodien | |
| 2012/0125023 | A1 | 5/2012 | Kopko et al. | |
| 2012/0205088 | A1* | 8/2012 | Morisita | B60L 58/27 165/202 |
| 2013/0199222 | A1 | 8/2013 | Moses | |
| 2014/0260391 | A1 | 9/2014 | Kopko | |
| 2016/0047578 | A1 | 2/2016 | Warren | |
| 2016/0076821 | A1 | 3/2016 | Kopko | |

FOREIGN PATENT DOCUMENTS

| | | | |
|---|---|---|---|
| EP | 2484992 | A1 | 8/2012 |
| WO | 2010098005 | A1 | 9/2010 |

OTHER PUBLICATIONS

Chinese Office Action for Chinese Application No. 201680086058; dated Jul. 24, 2020; 9 pages.
Chinese Office ACtion for Chinese Application No. 201680086058; dated Aug. 31, 2021, 10 pages.

* cited by examiner

AIR AND WATER COOLED CHILLER FOR FREE COOLING APPLICATIONS

BACKGROUND

The subject matter disclosed herein relates to heating, ventilation, air conditioning and refrigeration (HVACR) systems. More specifically, the subject disclosure relates to chiller systems utilized for air conditioning and/or refrigeration.

Chillers utilize a cooling source, such as refrigerant, to cool a heat transfer fluid at an evaporator. The heat transfer fluid is then circulated to a space to be cooled or refrigerated, where the air therein is cooled via thermal energy exchange with the heat transfer fluid. Further, the chiller often can operate in more than one mode, one of which is called "free cooling". In free cooling, cooling is achieved by taking advantage of low external temperatures to cool the heat transfer fluid. In typical systems, free cooling is accomplished through the addition of additional components such as dry liquid coolers or cooling towers.

Utilizing these additional components separately or directly mounted to the chiller, along with the necessary ancillary components such as valves and pumps present numerous problems. Among those include the initial cost of such components, the loss of overall system efficiency and increase in complexity due to the inclusion of the additional components. Further, such additional components, especially cooling towers can take up a large amount of space. Further, present systems are limited in that combined cooling, utilizing both free-cooling and traditional cooling simultaneously, is not feasible.

SUMMARY

In one embodiment, a heating, ventilation, air conditioning or refrigeration system includes a refrigerant circuit having a compressor, a first condenser, and a second condenser arranged in parallel or in series with the first condenser. A first expansion valve is in fluid communication with the first condenser to selectably direct a refrigerant flow through the first condenser, and a second expansion valve is in fluid communication with the second condenser to selectably direct the refrigerant flow through the second condenser. An evaporator is configured to remove thermal energy from a fluid flow through the evaporator via the refrigerant flow through the evaporator. A fluid flow circuit includes a liquid cooler in selectable fluid communication with the second condenser and/or the evaporator and the evaporator, through which the fluid flow is directed for thermal energy exchange with the refrigerant flow.

Additionally or alternatively, in this or other embodiments an output pump is configured to urge the fluid flow along the fluid flow circuit.

Additionally or alternatively, in this or other embodiments an input valve is configured to selectably direct the fluid flow toward the liquid cooler and/or toward the evaporator.

Additionally or alternatively, in this or other embodiments a liquid cooler valve selectably directs the fluid flow from the liquid cooler toward the second condenser and/or toward the evaporator.

Additionally or alternatively, in this or other embodiments the fluid flow circuit includes a first fluid circuit portion defined as a closed loop including the second condenser and the liquid cooler and excluding the evaporator, the first fluid circuit portion circulating a first fluid flow therethrough, and a second fluid circuit portion including the evaporator and circulating a second fluid flow therethrough.

Additionally or alternatively, in this or other embodiments the first fluid circuit portion includes a fluid pump to circulate the first fluid flow therethrough.

Additionally or alternatively, in this or other embodiments the evaporator is in fluid communication with a cooling location to provide the fluid flow to the cooling location for conditioning of the cooling location.

In another embodiment, a method of operating a heating, ventilation, air conditioning or refrigeration system includes urging a refrigerant flow through a compressor, flowing the refrigerant flow through a first condenser and a second condenser in a fluidly parallel, serial or independent arrangement with the first condenser. The refrigerant flow is directed through an evaporator, and first fluid flow is directed through the evaporator. A second fluid flow is circulated through a liquid cooler and through the second condenser. The refrigerant flow is cooled at the first condenser, the refrigerant flow is cooled at the second condenser via thermal energy exchange with the second fluid flow, and the first fluid flow is cooled at the evaporator via a thermal energy exchange between the flow of refrigerant and the first fluid flow.

Additionally or alternatively, in this or other embodiments a second fluid flow is circulated through a liquid cooler and through the second condenser via a fluid pump.

Additionally or alternatively, in this or other embodiments the refrigerant flow is cooled at the first condenser via an airflow across the first condenser.

Additionally or alternatively, in this or other embodiments the second fluid flow through the liquid cooler and through the second condenser is stopped, the refrigerant flow through the second condenser is stopped, and the first fluid flow is directed through the liquid cooler and through the evaporator in series.

Additionally or alternatively, in this or other embodiments the flow of refrigerant through the second condenser is stopped by closing a second condenser expansion valve.

Additionally or alternatively, in this or other embodiments the second fluid flow through the liquid cooler and through the second condenser is stopped, the refrigerant flow through the first condenser is stopped, the refrigerant flow through the second condenser is stopped, and the first fluid flow is directed through the liquid cooler and through the evaporator in series.

Additionally or alternatively, in this or other embodiments the flow of refrigerant through the first condenser and through the second condenser is stopped by stopping operation of the compressor.

Additionally or alternatively, in this or other embodiments the fluid flow from the evaporator is directed to a cooling location, and the cooling location is conditioned by flowing the fluid flow through a heat exchanger at the cooling location.

These and other advantages and features will become more apparent from the following description taken in conjunction with the drawings.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
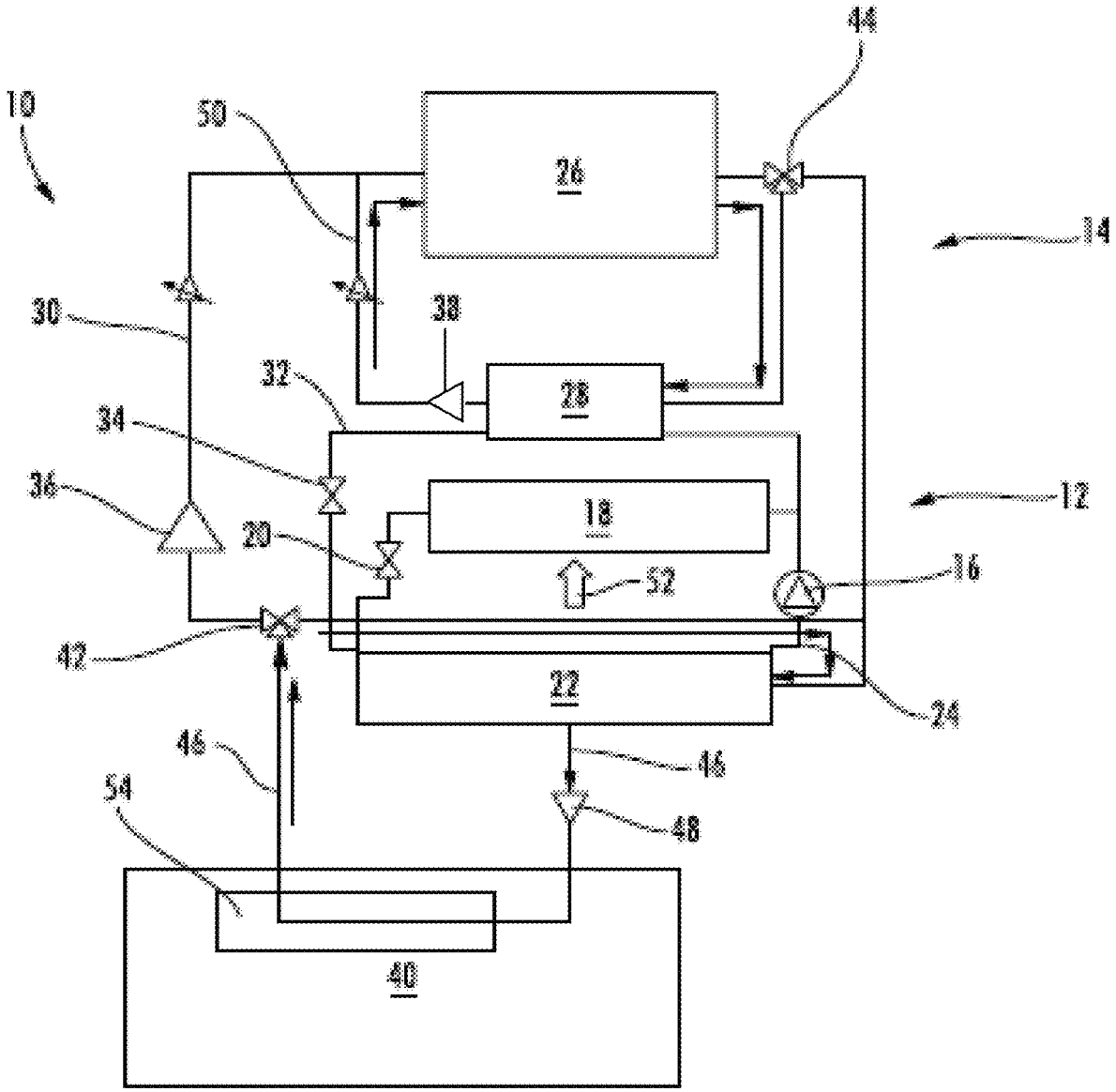
FIG. 1 is a schematic view of an embodiment of a heating, ventilation, air conditioning or refrigeration (HVACR) system in a first mode of operation.

FIG. 1 illustrates an embodiment of a heating, ventilation, air conditioning, refrigeration (HVACR) system 10. The HVACR system 10 is an integrated water and air cooled chiller with dry cooler on the same circuit or on different circuits, with a single or multiple evaporators, including both an air-cooled chiller 12 and a fluid-cooled chiller 14 associated to a dry cooler 26 to evacuate energy outside the system. The air-cooled chiller 12 includes a refrigerant compressor 16, a first condenser 18, a first expansion device 20 and an evaporator 22 arranged in serial communication about a refrigerant circuit 24, through which a flow of refrigerant is circulated in a vapor-compression cycle. The fluid-cooled chiller 14 includes a cooling source, such as the dry liquid cooler 26 connected to a second condenser 28 and to the evaporator 22 via a fluid circuit 30. The fluid circuit 30 further includes a condenser pump 36 to selectably urge fluid flow through the second condenser 28. Additionally, fluid flow is urged through the fluid circuit 30 via a fluid pump 38, which controls the flow of fluid to and from a cooling location 40, such as a room or other space. While water is an example of a fluid circulated through the fluid circuit 30, one skilled in the art will readily appreciate that other fluids may be utilized, such as a brine or glycol.

Further, the refrigerant circuit 24 includes a refrigerant circuit branch 32 extending through the second condenser 28 to connect the first condenser 18 and the second condenser 28 in a fluidly parallel or series arrangement or each one on different circuit. The refrigerant circuit branch 32 includes a second expansion device 34 to control flow of refrigerant through the second condenser 28. Valving, for example, an input valve is utilized to selectably direct the flow of fluid from the cooling location 40 to the liquid cooler 26 and/or the evaporator 22. Similarly, a liquid cooler valve 44 is utilized to selectably direct the flow of fluid from the liquid cooler 26 to the second condenser 28 and/or the evaporator 22. The input valve 42 and the liquid cooler valve 44 shown in FIG. 1 are three-way valves, but one skilled in the art will readily appreciate that other valve arrangements, such as a pair of two way valves, may be utilized to selectably direct the flow of fluid.

Three modes of operation of the HVACR system 10 will now be described with reference to FIG. 1-3. First, illustrated in FIG. 1 is operation of the HVACR system 10 in mechanical cooling mode. In mechanical cooling mode, both the first condenser 18 and the second condenser 28 and the liquid cooler 26 are utilized to provide cooling for the HVAC&R system 10. In this mode of operation, the input valve 42 and the liquid cooler valve 44 are set to direct a first flow of fluid 46 from the cooling location 40, through the evaporator 22 and back to the cooling location 40 through an output pump 48. Further, the input valve 42 and the liquid cooler valve 44 are set to circulate a second flow of fluid 50 between the liquid cooler 26 and the second condenser 28, driven by the fluid pump 38.

Compressor 16 is operated and expansion valves 20 and 34 are opened, such that refrigerant flows through both first condenser 18 and second condenser 28 arranged in parallel and through evaporator 22. The second flow of fluid 50 (shown in FIG. 1) is cooled at the liquid cooler 26, and cools refrigerant flowing through the second condenser 28 via a thermal energy exchange at the second condenser 28. The refrigerant is cooled at the first condenser 18 by an airflow 52 across the first condenser 18. In some embodiments, the airflow 52 is driven by a condenser fan (not shown). The refrigerant flows from both the first condenser 18 and the second condenser 28 through the evaporator, where the first flow of fluid 46 is cooled via thermal energy exchange with the refrigerant at the evaporator 22. The refrigerant is then flowed through the compressor 16, and the first flow of fluid 46 is circulated back to the cooling location 40 via the output pump 48. At the cooling location 40, the first flow of fluid 46 is utilized to condition the cooling location 40 via, for example, a heat exchanger 54, at the cooling location 40.

Figure 2:
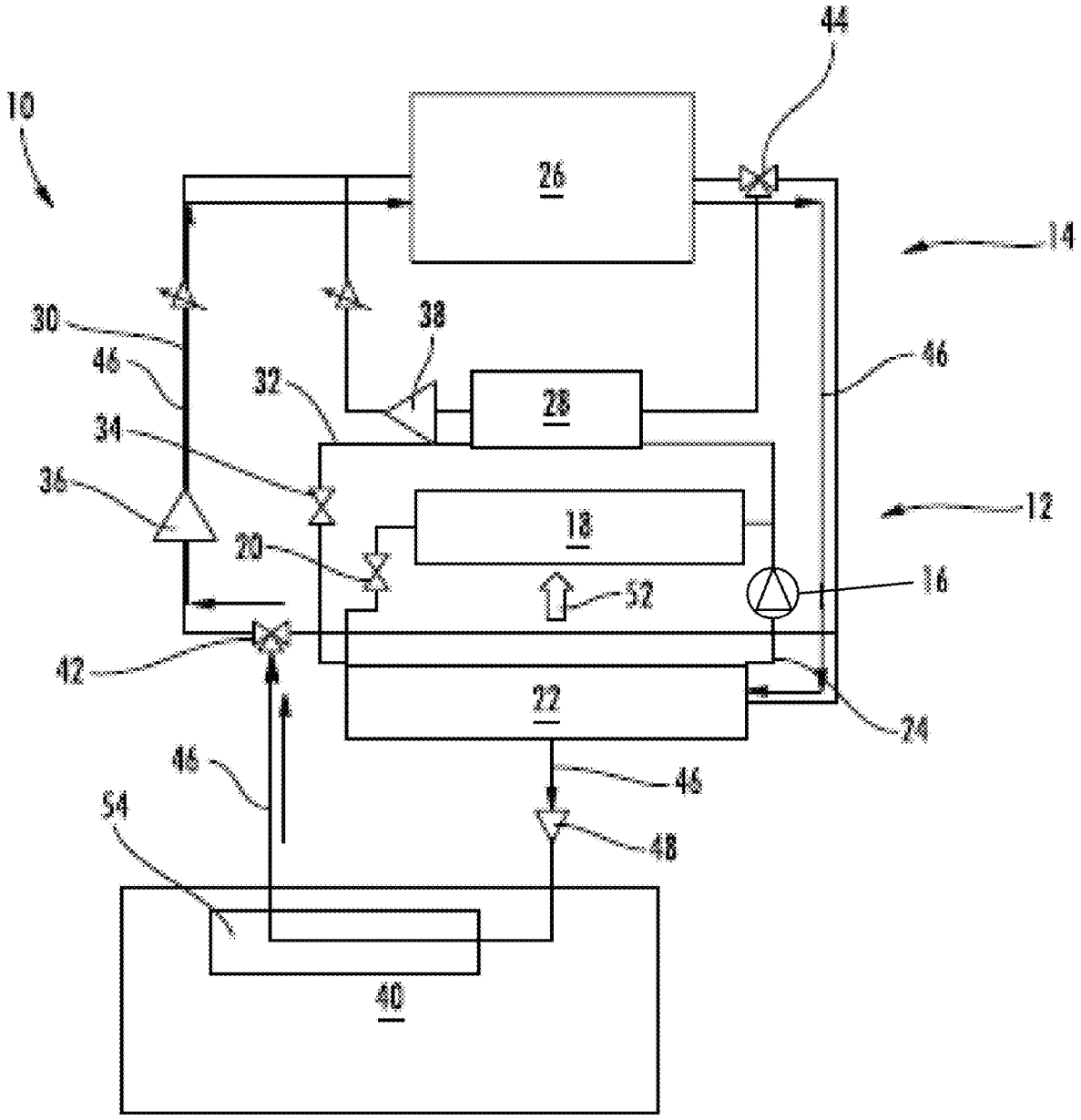
FIG. 2 is a schematic view of an embodiment of a heating, ventilation, air conditioning or refrigeration (HVACR) system in a second mode of operation.

Referring now to FIG. 2, a second mode of operation is combined cooling, in which mechanical cooling is provided utilizing the first condenser 18 and free cooling is provided via the liquid cooler 26 in series with the evaporator 22. In combined cooling mode, the fluid pump 38 is stopped and the liquid cooler valve 44 is set to bypass the second condenser 28. The input valve 42 is set to direct the first fluid flow 46 toward the liquid cooler 26, through the liquid cooler 26 and to the evaporator 22. The first flow of fluid 46 is cooled at the liquid cooler 26 and cooled additionally at the evaporator 22 by the refrigerant. The first flow of fluid 46 is then directed back to the cooling location 40 by the output pump 48. While in the embodiment shown, the first flow of fluid 46 passes through the liquid cooler 26 before passing through the evaporator 22, it is to be appreciated that in some embodiments, the positions of the components may be changed, or the flow through the components may be changed such that the first flow of fluid 46 passes through the evaporator 22 and then is cooled additionally by passing through the liquid cooler 26.

Compressor 16 is operated, and expansion valve 20 is opened, but expansion valve 34 is closed, thus refrigerant flows through first condenser 18 for cooling, but refrigerant does not flow through second condenser 28 in this mode. The first flow of fluid 46 is cooled at the first condenser 18 by thermal energy exchange between the refrigerant and the first flow of fluid 46.

Figure 3:
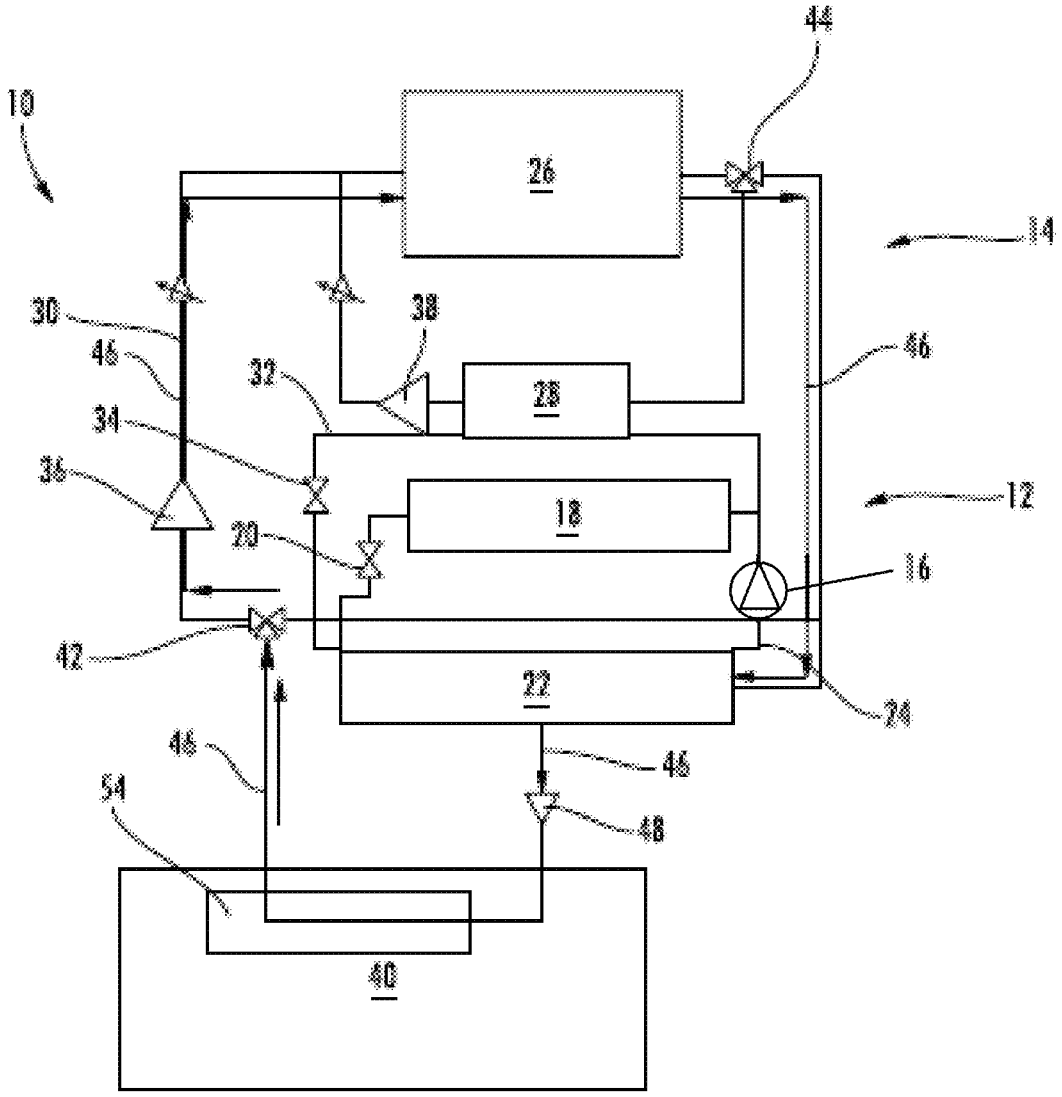
FIG. 3 is a schematic view of an embodiment of a heating, ventilation, air conditioning or refrigeration (HVACR) system in a third mode of operation.

FIG. 3 illustrates a third mode of operation of the HVACR system 10, free cooling mode. In free cooling mode, cooling is achieved utilizing only the liquid cooler 26 as a source of cooling for the HVACR system 10. In free cooling mode, the compressor 16 is stopped, and both first expansion valve 20 and second expansion valve 34 are closed, such that refrigerant flow through the first condenser 18, the second condenser 28 and the evaporator 22 is stopped. Further, dry cooler valve 44 is set to bypass the second condenser 28 and the dry cooler pump 38 is stopped, so there is no fluid flow through the second condenser 28. Input valve 42 is set to direct the first flow of fluid 46 toward the liquid cooler 26. The first flow of fluid 46 circulation is driven by the output pump 48, which urges the first flow of fluid 46 from the cooling location 40, through the liquid cooler 26 where the first flow of fluid 46 is cooled, through the evaporator 22 and back to the cooling location 40. Alternatively, in other embodiments additional valving and/or piping may be utilized such that the first flow of fluid 46 bypasses the evaporator 22.

The HVACR system 10 disclosed herein combines a water cooled chiller 14 with a dry liquid cooler 26 and an air cooled chiller 12 enabling mechanical cooling operation, free cooling operation and combined cooling operation in the same footprint as separate water cooled chiller 14 and air cooled chiller 12, by arranging the first condenser 18 and the second condenser 28 in a fluidly parallel or series relationship on the same or on separated circuits. Efficiency and capacity of the HVACR system 10 maybe higher than traditional free cooling solutions for same footprint. For the same overall cooling capacity, the size of refrigerant coils can be reduced. While reducing refrigerant coils, cost and footprint of the system are also reduced; and system efficiency may be improved.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A heating, ventilation, air conditioning or refrigeration system comprising:

a refrigerant circuit including:

a compressor;

a first condenser;

a second condenser operably connected to the first condenser;

a first expansion valve in fluid communication with the first condenser to selectably direct a refrigerant flow through the first condenser;

a second expansion valve in fluid communication with the second condenser to selectably direct the refrigerant flow through the second condenser; and an evaporator fluidly connected to each of the compressor, the first condenser and the second condenser, the flow of refrigerant directed through the evaporator;

a fluid flow circuit including:

the evaporator;

a heat exchanger disposed at the cooling location and fluidly connected to the evaporator, such that a fluid flow is directed from the evaporator through the heat exchanger;

a liquid cooler fluidly connected to the evaporator; and the second condenser fluidly connected to the evaporator and the liquid cooler;

wherein the fluid flow from the heat exchanger is selectably directed to one of the evaporator or the liquid cooler; and wherein the fluid flow is selectably directed from the liquid cooler to one of the evaporator or the second condenser;

wherein each of the first condenser and the second condenser are fluidly connected to the evaporator such that refrigerant flow is directed from each of the first condenser and the second condenser through the evaporator, without passing through the other of the first condenser and the second condenser.

2. The heating, ventilation, air conditioning or refrigeration system of claim 1, further comprising an output pump to urge the fluid flow along the fluid flow circuit.

3. The heating, ventilation, air conditioning or refrigeration system of claim 1, further comprising an input valve to selectably direct the fluid flow toward the liquid cooler and/or toward the evaporator.

4. The heating, ventilation, air conditioning or refrigeration system of claim 1, further comprising a liquid cooler valve to selectably direct the fluid flow from the liquid cooler toward the second condenser and/or toward the evaporator.

5. The heating, ventilation, air conditioning or refrigeration system of claim 1, wherein the fluid flow circuit includes a fluid pump to circulate the fluid flow therethrough.

* * * * *